United States Patent [19]

Drever

[11] Patent Number: 4,791,674

[45] Date of Patent: Dec. 13, 1988

[54] MICROPHONE SUSPENSION ASSEMBLY

[76] Inventor: Leslie C. Drever, 8525 Tobias Ave., Apt. 1, Panorama City, Calif. 91402

[21] Appl. No.: 108,776

[22] Filed: Oct. 14, 1987

[51] Int. Cl.[4] ..... H04R 1/02

[52] U.S. Cl. ..... 381/169; 381/205

[58] Field of Search ..... 381/158, 168, 169, 188, 381/205

[56] References Cited

U.S. PATENT DOCUMENTS 3,452,955 7/1969 Hartwig ..... 381/205 X 4,194,096 3/1980 Ramsey ..... 381/169

*Primary Examiner*—Eugene R. LaRoche

*Assistant Examiner*—Steven J. Mottola

*Attorney, Agent, or Firm*—John J. Posta, Jr.

[57] ABSTRACT

The microphone suspension assembly includes a preferably rectangular flat horizontal frame formed of a number of longitudinally extending parallel stipp rods interconnected by transverse flexible resilient bands of elastomeric material. Rods between the side margins of the frame are releasably connected to a rod connector which in turn is connectable to a microphone support such as a stand, handle or boom. A bridge has depending legs connected at their lower ends to rods at the frame side margins. The bridge is generally inverted V-shaped and rises above the frame and bears a microphone connector in the form of a hemispherical longitudinally extending open topped slot in the upper end thereof, which is dimensioned to snugly receive the barrel of a microphone and hold it suspended in a balanced position above the frame out of direct contact with the frame. The portions of the bridge defining the slot may be formed of resilient material or can be spring biased to releasably grip the microphone barrel. The assembly prevents or greatly dampens jarring of the microphone even when the support, handle or boom to which it may be connected is subject to jarring and even when the microphone itself is contacted. Sound distortion due to jarring is eliminated. The assembly is simple, easy to connect to a microphone and is fully adjustable.

12 Claims, 2 Drawing Sheets

MICROPHONE SUSPENSION ASSEMBLY

BACKGROUND OF THE INVENTION

1. FIELD OF THE INVENTION

The present invention generally relates to support means and, more particulary, to improved shock-absorbing microphone supports.

2. PRIOR ART

Microphones are usually directly connected to rigid supports such as stands, booms and the like so that when either the microphone or the support is jarred, the microphone suffers noise generation and sound distortion, as well as possible damage. Thus, microphone holders such as those shown in U.S. Pat. Nos. 3,324,254, 1,887,637, 4,040,547, 3,562,446, 2,421,437, 2,235,518, 2,129,898 and 2,122,778 are all subject to the above-described deficiency.

Accordingly, there is a need for an improved microphone suspension assembly which will effectively cushion the microphone against sudden jarring, bumps and knocks that can produce noises, sound distortion and damage to the microphone. Such assembly should preferably be adjustable and easy to install and remove.

SUMMARY OF THE INVENTION

The improved microphone suspension assembly of the present invention satisfies all the foregoing needs. The assembly is substantially as set forth in the Abstract. Thus, it comprises a preferably generally flat, horizontal frame formed of spaced parallel longitudinally extending rods interconnected at their ends to transverse elastomeric bands, such as doubled or undoubled rubber bands. One or more rods between the frame sides are releasably connected to a rod connector so that the frame can oscillate therearound. Those rods can have band fittings at their ends. That connector can, in turn, releasably connect the frame to a stand, boom or handle or other rigid microphne support. The frame is also connected at the sides thereof to a bridge which rises above the frame and which bears an open topped preferably generally hemispherical in end view longitudinal slot or other means for releasably connecting the bridge to the barrel of a microphone. The portion of the bridge which grips the microphone barrel can be flexible and elastic or spring biased or the like. The microphone is held up out of the way of the bridge, frame, bottom connector and base support. The position of the microphone on the assembly is readily adjustable for proper balance. Any jars directly to the microphone are cushioned by the frame, as are bumps, jars, etc. traveling from the microphone base support up through the connector to the frame. Accordingly, the microphone is effectively isolated from undesired sound generation and distortion, and also damage, all because of the improved suspension assembly of the present invention.

Further features of the present invention are set forth in thefollowing detailed description and accompanying drawings.

DRAWINGS

DETAILED DESCRIPTION

Figure 1:
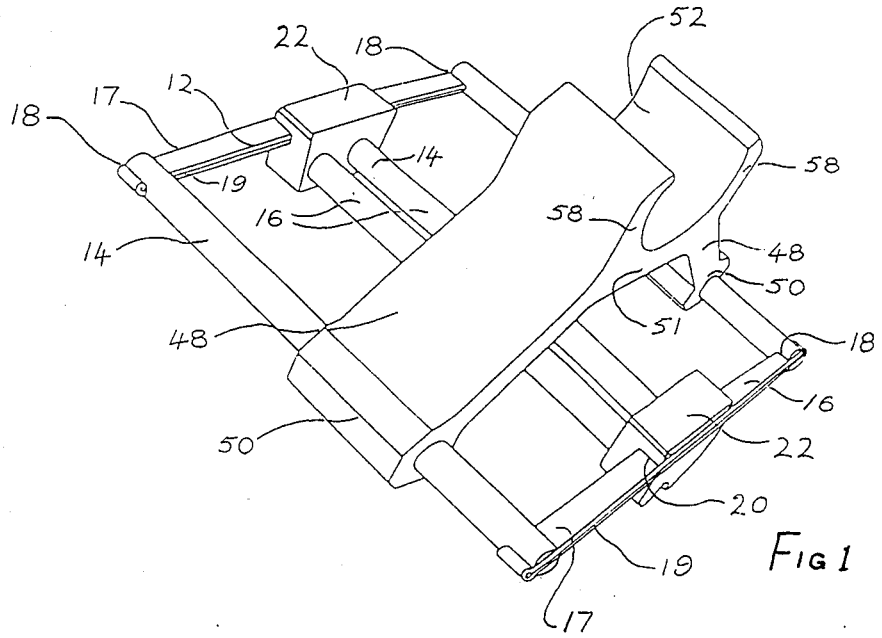
FIG. 1 is a schematic top perspective view of a first preferred embodiment of the frame and bridge of the improved assembly of the present invention.
Figure 2:
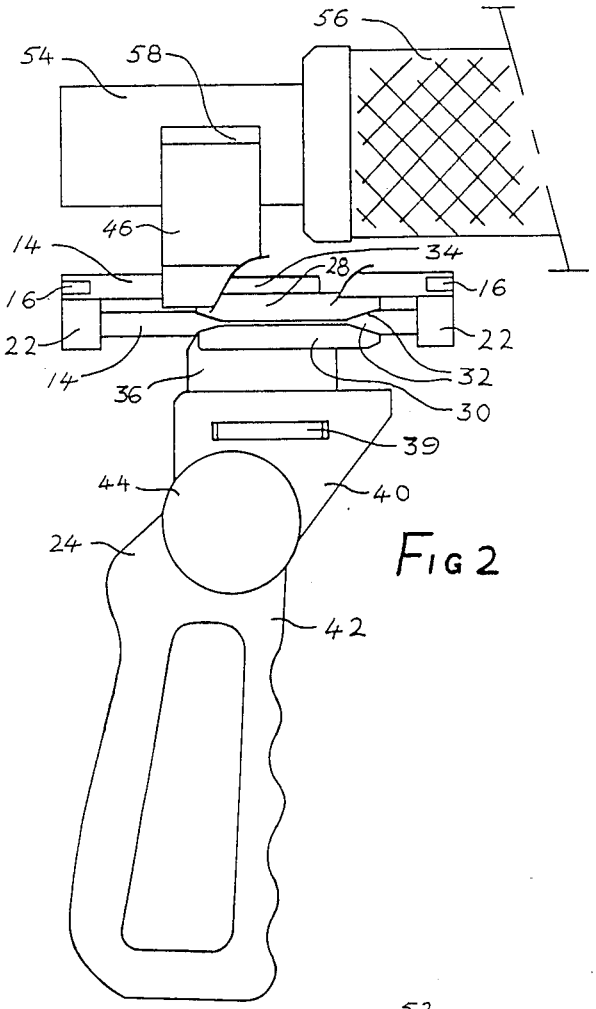
FIG. 2 is a schematic side elevation, partly broken away, of a first preferred embodiment of the improved assembly of the present invention, incorporating the frame of FIG. 1 and showing a microphone in place therein; and, FIG. 3 is a schematic fragmentary rear end view of a second preferred embodiment of the improved assembly of the present invention.

FIGS. 1 and 2

Now referring more particularly to FIGS. 1 and 2 of the drawings, a first preferred embodiment of the improved microphone suspension assembly of the present invention is schematically depicted therein. Thus, suspension assembly 10 is shown which comprises a generally horizontal frame 12 formed of a plurality, in this case 4, parallel longitudinally extending preferably stiff rods 14 of metal, plastic or the like interconnected at their ends by transversely extending flexible resilient bands 16 of elastomeric material, such as rubber or plastic.

In the embodiment of FIGS. 1 and 2, each band 16 is a loop held in slots 18 in the two rods 14 on the side margins of frame 12 and in slots 20 in rectangular fittings 22 secured to the ends of those two rods 14 which are medial of the side margins of frame 12, preferably at about the longitudinal center line thereof.

The strands 17 and 19 of bands 16 lie flat against each other and thus effectively providing a double band 16. The medial rods 14 may be, as shown, slightly below the side margin rods 14.

Frame 12 is preferably rectangular and flat and is preferably held in a horizontal attitude when releasably connected to a base support such as a rigid handle 24 by a rod connector 26, specifically connected to the medial rods 14. In this regard, connector 26 includes a top plate 28, a bottom plate 30, both bearing rod-receiving longitudinal grooves 32, and a knurled knob 34 threadably screwed down through plates 28 and 30 to releasably hold them together.

Plate 30 is T-shaped (in end view) with a bottom leg 36 releasably locked in a groove (not shown), as by screw-bearing knob 39 in the upper end of handle 24. Handle 24 has an upper portion 40 and a lower portion 42 releasably joined together by set knob 44 to control the hand angle of handle 24.

Assembly 10 also includes a bridge 46 which is of a generally inverted V-shape, with a pair of diverging depending legs 48 connected at their lower ends 50 to rods 14 at the side margins of frame 12. Microphone connector means are disposed in the apex or upper end 51 of bridge 48 and comprise a generally hemispherical (in end view) open topped slot 52 extending longitudinally therethrough and adapted to releasably receive the barrel 54 (FIG. 2) of a microphone 56, so that microphone 56 is held up out of direct contact with the remainder of bridge 46 and with frame 12, connector 26 and handle 24. Thus, screening on microphone 56 is not interfered with by assembly 10.

The position of microphone 56 relative to bridge 46 can be adjusted by sliding barrel 54 forward or backward (longitudinally) in slot 52 so as to be able to properly center and balance microphone 56 above assembly 10 for maximum movement. Preferably, the portions 58 of end 51 defining slot 52 snugly but releasably grip barrel 54. In this regard, portions 58 may be of flexible resilient material such as rubber or plastic, so as to flex open enough to receive barrel 54. Other means can be used to enable the gripping action, as hereinafter described in connector with FIG. 3.

Accordingly, an improved shock-absorbing, shock-resistant microphone suspension assembly is thus provided. Because resilient flexible frame 12 is interposed between microphone 56 and handle 28, jars, bumps, etc., emanating at handle 38 or at microphone 56 are softened, dampened and suppressed by frame 12, which absorbs the same and can oscillate in all directors as a result, so that microphone 56 is protected against damage and also against undesired sound generation and sound distortion.

Assembly 10 permits the position of frame 12 relative to connector 26 and handle 24 to be readily adjusted. In addition, if desired, bridge 46 can either be pinned in place on frame 12 or can be allowed to frictionally slide, preferably with some difficulty, thereon. Moreover, barrel 54 can slide longitudinally in slot 52. Accordingly, the relative positions of microphone 56, frame 12, bridge 46 and handle 38 can be easily changed, if and as desired. Handle 38, connector 26, rods 14 and the main portion of bridge 46 can be made of metal, or of plastic, etc., in an economical, simple, durable manner.

FIG. 3

Figure 3:
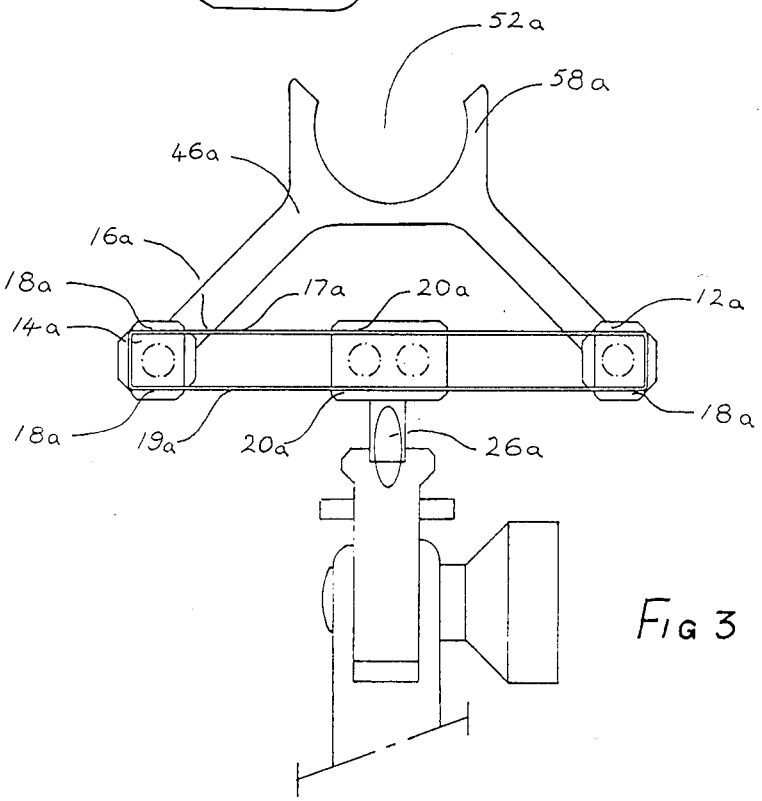

A second preferred embodiment of the improved assembly of the present invention is schematically depicted in FIG. 3. Thus, assembly 10*a* is shown. Components thereof similar to those of assembly 10 bear the same numerals, but are succeeded by the letter "a". Assembly 10*a* is identical to assembly 10, except as follows:

(a) bridge 46*a* is identical to bridge 46 except that it is split vertically through slot 52*a* and end 51*a* into two identical halves connected by a spring hinge 60 biasing portions 58*a* toward each other to releasably grip the barrel of a microphone (not shown) when in slot 52*a* and portions 58*a* can be spread apart by bearing down on rods 14*a* at the side margins of frame 12*a* against such biasing action; and, (b) bands 16*a* are undoubled and ends of side margin rods 14*a* are expanded to accommodate both strands 17*a* and 19*a* in separate pairs of slots 18*a* and 20*a* in the ends of rods 14*a*. Frame 12*a* is otherwise identical to frame 12. Assembly 10*a* has the other advantages of assembly 10.

Various other modifications, changes, alterations and additions can be made in the improved microphone suspension assembly of the present invention, its components and parameters. All such modifications, changes, alterations and additions as are within the scope of the appended claims form part of the present invention.

What is claimed is:

1. An improved shock-resistant microphone suspension assembly, said assembly comprising, in combination:

(a) a generally horizontal flat frame comprising a plurality of spaced longitudinally extending rods, and a plurality of spaced transversely extending flexible resilient bands interconnecting said rods;

(b) a rod connector releasably connected to at least one of said rods for connection of said frame to a rigid microphone base support;

(c) a bridge above said rods and having a pair of depending legs connected adjacent their lower ends to said rods, said bridge having a microphone connector for releasably holding a microphone above the remainder of said bridge and above said frame for mechanical shock isolation by said frame.

2. The improved suspension assembly of claim 1 wherein said bands are parallel and elastomeric and are connected to said rods and said rods are relatively inflexible and generally parallel.

3. The improved suspension assembly of claim 1 wherein said frame is generally rectangular with said bands disposed in slots at opposite ends of said rods.

4. The improved suspension assembly of claim 3 wherein said bands abut each other and are held in the same slots in said rod ends, for effective doubling of said bands.

5. The improved suspension assembly of claim 3 wherein each said band is a rubber band releasably held in a pair of parallel slots in each rod.

6. The improved suspension assembly of claim 1 wherein said bridge is slideable on said rods.

7. The improved suspension assembly of claim 1 wherein said rod connector is releasably connected to a pair of rods at about the longitudinal center line of said frame for improved shock absorbing frame oscillation.

8. The improved suspension assembly of claim 7 wherein said pair of rods releasably slideably receive said rod connector, whereby said frame is repositionable longitudinally relative to said rod connector, and wherein said pair of rods contain fittings at the opposite ends thereof releasably receiving said bands.

9. The improved suspension assembly of claim 1 wherein said bridge bears a curved longitudinally extending generally hemispherical open topped slot therein adapted to snugly releasably receive a microphone.

10. The improved suspension assembly of claim 9 wherein portions of said bridge are resilient so as to releasably grip said microphone.

11. The improved suspension assembly of claim 1 wherein said bridge has a generally inverted V shape in end view.

12. The improved suspension assembly of claim 11 wherein said bridge is vertically divided into two parts through a portion thereof and said portions are spring biased together to releasably grip a microphone barrel.

* * * * *